US006082159A

United States Patent [19]

Larsen

[11] Patent Number: 6,082,159

[45] **Date of Patent: *Jul. 4, 2000**

[54] POCKET LOCK PICK

[76] Inventor: Ernest F. Larsen, 2544 E. Holmes Ave., Mesa, Ariz. 85204

[ * ] Notice: Under 35 U.S.C. 154(b), the term of this patent shall be extended for 72 days.

[21] Appl. No.: 08/699,262

[22] Filed: Aug. 19, 1996

[51] Int. Cl.[7] ..... E05B 19/20

[52] U.S. Cl. ..... 70/394; 33/540

[58] Field of Search ..... 70/456 R, 394, 70/61, 397, 395, 393; 33/539, 340; 401/29, 33

[56] References Cited

U.S. PATENT DOCUMENTS

| | | | |
|---|---|---|---|
| 1,701,771 | 2/1929 | Di Stefano | 70/456 R |
| 2,208,498 | 7/1940 | Cramer | 70/456 R |
| 2,232,333 | 2/1941 | McGehee | 70/456 R |
| 2,407,832 | 9/1946 | Hotvedt | 70/456 R |
| 2,837,057 | 6/1958 | Morlock et al. | 401/33 |
| 3,092,244 | 6/1963 | McWhirter | 70/456 R |
| 3,174,462 | 3/1965 | Bross | 401/33 |
| 3,452,562 | 7/1969 | Loveless | 70/394 |
| 3,478,549 | 11/1969 | Schlage | 70/408 |
| 3,527,072 | 9/1970 | Demetreon | 70/456 R |
| 4,031,730 | 6/1977 | Kern | 70/419 |
| 4,606,204 | 8/1986 | Cooke, Jr. | 70/394 |
| 4,631,770 | 12/1986 | Goldberg | 70/456 R |
| 4,778,302 | 10/1988 | Martinez | 70/456 R |
| 5,138,852 | 8/1992 | Corcoran | 70/16 |
| 5,368,406 | 11/1994 | Hanshaw | 70/61 |

FOREIGN PATENT DOCUMENTS

| | | | |
|---|---|---|---|
| 2340434 | 9/1977 | France | 70/394 |

*Primary Examiner*—Darnell Boucher

[57] ABSTRACT

A compact lock pick assembly constructed and configured to be carried in a shirt pocket comprising the combination of a lock pick tool that is retractable into a generally tubular handle and a tension tool mounted on the tubular handle to act as a pocket clip is disclosed.

3 Claims, 1 Drawing Sheet

POCKET LOCK PICK

FIELD OF THE INVENTION

This invention relates to locksmithing and locksmith tools and, more specifically, to devices known as lock picks for opening a pin-tumbler type lock without having a key.

BACKGROUND OF THE INVENTION

One of the more popular types of mechanical locks is referred to as the pin-tumbler lock or pin-tumbler cylinder lock. Pin-tumbler cylinders are used in a great variety of locks including padlocks, door locks, automobile vehicle locks, and in specialty locks. This type of lock is so well known and widely used that a detailed description is unwarranted. Generally, the lock comprises a cylinder which receives a plug the rotation of which opens or closes the lock. The plug carries a plurality of pins that are slidably received in lateral passages. The pins are spring biased to the closed position. The pins are of different lengths and, therefore, align with the open position only when the proper key is inserted. When the proper key is inserted, the pins are positioned so that they do not extend into the cylinder nor do pins mounted in the cylinder extend into the plug. In this position, and only in this position, do the pins permit rotation of the plug and, consequently, the opening of the lock.

Lock picks are also well known. Lock picks come in a variety of sizes and shapes and are useful for different kinds of locks. One of the more common kinds of lock picks is used for the pin-tumbler type of lock. One type of lock pick for the pin-tumbler type of lock uses a small flat tool with one or more projections thereon and a tension tool. As the tension tool is used to turn the plug, or exert a turning force on the plug, the pick is inserted into the lock and moved forwardly and backwardly along the plug pushing the pins up. By careful manipulation, the pins will align themselves to the open position and the tension will keep them in the open position until all of them are aligned and the lock opens. It is to this type of lock pick that the present invention is directed.

In operational concept these lock picks have been known for a very long time and are known in a variety of sizes and shapes. The present invention comprises an assembly which is easily carried in the shirt pocket of the locksmith and can be used quickly and efficiently. Those who have need to work on locks regularly, maintenance personnel, etc., will also find the configuration of the compact lock pick assembly of this invention to be a great convenience.

The object of this invention, then, is to provide a compact lock pick assembly that is constructed and configured for being carried in a shirt pocket that comprises all of the elements necessary to open at pin-tumbler type of lock, and other locks that are similarly opened.

SUMMARY OF THE INVENTION

The present invention is a compact lock pick assembly that is specially constructed and configured for being carried in a shirt pocket of the user. A tubular handle constructed and configured to fit in a shirt pocket of the user generally determines the overall configuration of the device when not in use. The tubular handle is a hollow tube having a proximal end and a distal end, and a central axis. The tube is constructed to form an elongate slot extending from proximate the proximal end to proximate the distal end and also to define through the wall an aperture proximate the distal end of the tube. An elongate lock pick tool is fastened to a lock pick carrier that is slidably received in the tube for movement reciprocally from a first position proximate the proximal end of the tube at which the lock pick tool extends from the proximal end of the tube to a second position proximate the distal end of the tube at which position the lock pick is inside the tube. Means are provided for selectively securing the lock pick carrier proximate the proximate end of the tube and, selectively, proximate the distal end of the tube extend through the slot in the tube. A generally L-shaped tension tool having a long leg and a short leg, the short leg being constructed and configured to extend through the aperture into the tube is an important part of the assembly. Means for selectively releasing the L-shaped tension tool for use and for locking the L-shaped tension tool to the tube with the long leg thereof lying longitudinally of and adjacent to the tube thereby forming a clip for holding the lock pick assembly in a user's pocket are provided. A lock pick guide and stop secured to the proximal end of the tube is configured to guide the proximal end of the assembly into the user's pocket during non-use, as well as to steady and guide the lock pick during use, and to prevent the lock pick carrier from slipping out of the tube.

DESCRIPTION OF THE PREFERRED EMBODIMENT

The present invention resides in the assembly or combinational aspects as described and not in the individual components. Various components may be substituted, for example, without departing from the spirit and scope of the invention.

Figure 1:
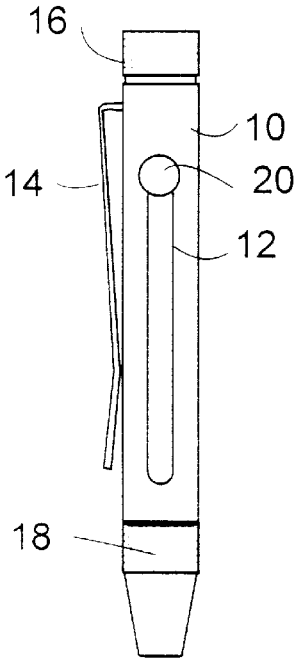
FIG. 1 a side elevational view depicting the assembly of this invention it the non-use configuration as it would be carried in the user's shirt pocket.

Reference is made first to FIG. 1 which depicts the invention in its non-use form ready to be inserted into the pocket of a user.

The lock pick assembly comprises a tube 10 which has an elongate slot 12 formed in the side, the slot extending from near the proximal end to a point approaching the distal end of the tube. The tube also has formed therein an aperture 13 which is not shown in FIG. 1 into which the short leg of a generally L shaped tension tool 14 is inserted as shown in FIG. 1. A knurled locking cap 16 locks the L shaped tension tool to the assembly with the L shaped tension tool lying alongside the tube and forming a clip so that when the tool is placed in the user's pocket, the clip retains it in the pocket. A lock pick guide and stop is secured on the proximal end of the tube which positions and guides the lock pick during use and also guides the proximal end of the tube during non-use where it is inserted into the user's pocket.

Figure 2:
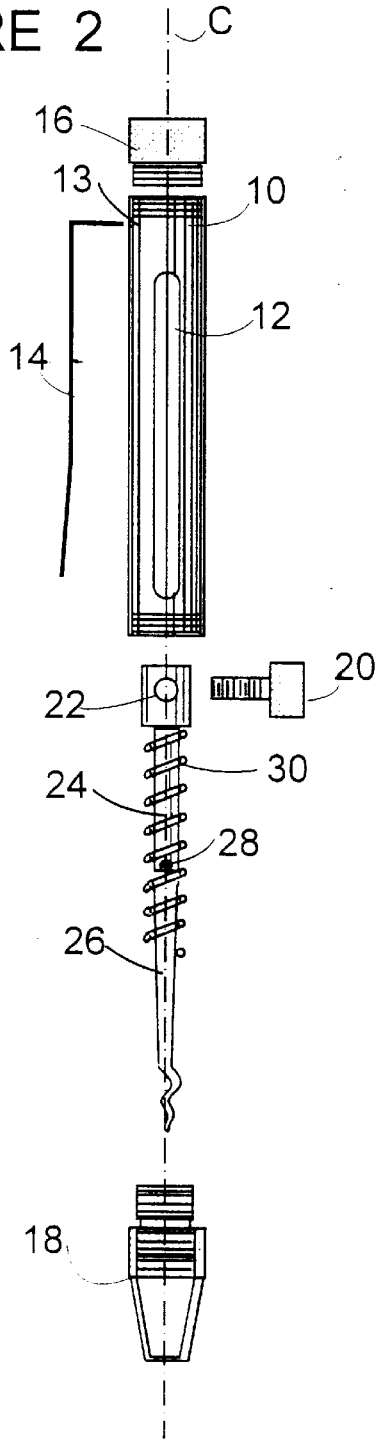
FIG. 2 is an exploded view of the assembly of this invention showing each of the components of the assembly.
Figure 3:
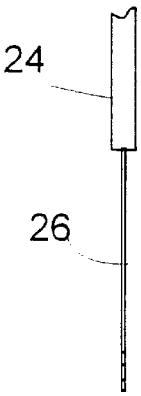
FIG. 3 is a side elevational view of the pick tool and a portion of the pick tool carrier rotated 90 degrees with respect to the view of the same in FIG. 2, the spring not being shown in FIG. 3.

Referring now to FIGS. 2 and 3, all of the components of the invention and their interrelationship one to another are described. FIG. 2 is an exploded view of the compact lock pick assembly of this invention being exploded generally along a center line C which is also the axis of the tube. It will be noted that most of the components lie along and/or are coaxial with the center line C. The L shaped tension tool 14 is insertable into the aperture 13, which is shown in FIG. 2, to attain the position indicated in FIG. 1. The cap 16 comprises a knurled handled portion and a threaded portion, the threaded portion being threadably received in the distal end of the tube 10 for locking the L shaped tension tool in the aperture 13. The proximal end cap 18 is also threadably received in the tube, in threads formed on the proximal end of the tube. As will be described, the proximal cap 18 comprises a lock pick guide and stop and is configured to guide the proximal end of the assembly into the users pocket during non-use and to steady and guide the lock pick during use and also to prevent the lock pick carrier from slipping out of the tube, as described hereinafter.

A lock pick carrier comprising a cylindrical portion 22 which is attached to or unitarily formed with a smaller diameter cylindrical portion 24 is slidably received in the tube 10 and can be fixed at positions proximate the distal end, or the proximal end or, intermediately, by means of the screw 20 which extends into the aperture shown in the slide 22, which is treaded, thereby clamping the slidable lock pick carrier in any desired position along the length of the slot 12. The pick itself, identified by numeral 26, is secured to the end of the pick carrier by means of a set screw 28 or any other desired fastening means. Referring briefly to FIG. 3, it will be seen that the carrier is cylindrical whereas the pick is flat. Referring now again to FIG. 2, a spring 30 biases the lock pick carrier and, consequently the lock pick to the distal end of the tube 10 at which biased position the lock pick carrier and the lock pick are inside the tube and the proximal cap 18.

When the user desires to open a lock using the lock pick assembly, the cap 16 is loosened and the tension tool 14 is removed from the assembly and the screw 20 is loosened to permit the pick to extend out of the tube which forms a handle for the pick during use. The pick is fixed in its extended position by tightening the screw 20 again clamping the lock pick carrier to the tube. The lock pick guide and stop 18 secured to the proximal end of the tube aligns the pick centrally along the axis defined by the tube, which is congruent with the center line C. It will be noted that the lock pick guide and stop is tapered toward its proximal end and thus engages the lock pick carrier and the lock pick and prevents them from sliding from the tube, except for maintenance when the lock pick guide and stop are removed. The user then has available a convenient handle with which to manipulate the pick. The tension tool is used to apply tension to the plug. The short leg of the tension tool is inserted into the plug and the plug is placed under tension toward the opening direction. The pick is inserted into the lock and is moved in and out of the lock and is used to manipulate the pins, sliding them inwardly and outwardly in their respective passages. With tension applied to the plug, the pins will tend to remain in the position at which the lock is openable. When all of the pins have been positioned properly, the plug turns and the lock is opened.

The use of a lock pick is, of course, well known, and those skilled in the art know that it takes some considerable practice to become proficient in using the tool.

The advantage of this invention is at least twofold. First of all, it is in a very convenient configuration for being carried about by the user between uses and, secondly, the tool which carries the pick during non-use forms a very secure and easily grasped handle for using the lock pick.

What is claimed is:

1. A compact lock pick assembly constructed and configured for being carried in a shirt pocket comprising, in combination:

a tubular handle constructed and configured to fit in a shirt pocket of a user, the tubular handle being a tube having a proximal end and a distal end, the tube being constructed to define through the wall an aperture proximate the distal end of the tube;

an elongate lock pick tool;

a generally cylindrical lock pick tool carrier means fastening the lock pick tool to the lock pick carrier;

the lock pick carrier being slidably received in the tube for movement reciprocally from a first position proximate the proximal end of the tube at which the lock pick tool extends from the proximal end of the tube to a second position proximate the distal end of the tube at which position the lock pick tool is inside the tube;

means for selectively securing the lock pick carrier proximate the proximate end of the tube and, selectively, at proximate the distal end of the tube;

a generally L-shaped tension tool having a long leg and a short leg, the short leg being constructed and configured to extend through aperture proximate the distal end of the tube, the tube and the L-shaped tension tool being so configured and constructed that when the short leg of the L-shaped tension tool extends through aperture proximate the distal end of the tube the long leg of said tension tool extends approximately to the proximal end of the tube and forms a clip for securing the lock pick assembly in the user's pocket; and means for selectively releasing the L-shaped tension tool for use and for locking the L-shaped tension tool to the tube with the long leg thereof lying longitudinally of and adjacent to the tube thereby forming a clip for holding the lock pick assembly in a user's pocket.

2. The lock pick assembly of claim 1 wherein the tube is constructed to form an elongate slot extending from proximate the proximal end to proximate the distal end and wherein the means for selectively securing the lock pick carrier extends through said elongate slot.

3. The lock pick assembly of claim 1 further comprising a lock pick tool guide and stop secured to the proximal end of the tube.

* * * * *